US007201706B1

(12) United States Patent
Lee et al.

(10) Patent No.: US 7,201,706 B1
(45) Date of Patent: Apr. 10, 2007

(54) ELLIPTICAL EXERCISING APPARATUS

(75) Inventors: Sunny Lee, No. 48-20, Ching-Chai Lane, Nan-Pu Li, Tsao-Tun Chen, Nan-Tou Hsien (TW); Simon Chao, Nan-Tou Hsien (TW)

(73) Assignee: Sunny Lee, Hsien (TW)

( * ) Notice: Subject to any disclaimer, the term of this patent is extended or adjusted under 35 U.S.C. 154(b) by 0 days.

(21) Appl. No.: 11/251,307

(22) Filed: Oct. 14, 2005

(51) Int. Cl.
*A63B 22/04* (2006.01)
*A63B 69/16* (2006.01)

(52) U.S. Cl. ..... 482/52; 482/57

(58) Field of Classification Search ..... 482/51, 482/52, 57, 70, 79–80
See application file for complete search history.

(56) References Cited

U.S. PATENT DOCUMENTS 6,152,859 A * 11/2000 Stearns ..... 482/52
6,196,948 B1 * 3/2001 Stearns et al. ..... 482/52
6,340,340 B1 * 1/2002 Stearns et al. ..... 482/52
6,454,682 B1 * 9/2002 Kuo ..... 482/52
6,575,877 B2 * 6/2003 Rufino et al. ..... 482/51
6,620,079 B2 * 9/2003 Kuo ..... 482/51
6,719,666 B1 * 4/2004 Lo et al. ..... 482/52
6,994,656 B2 * 2/2006 Liao et al. ..... 482/52
7,041,036 B1 * 5/2006 Kuo ..... 482/52

* cited by examiner

*Primary Examiner*—Stephen R. Crow
(74) *Attorney, Agent, or Firm*—Kirschstein, et al.

(57) ABSTRACT

An elliptical exercising apparatus includes two longitudinal slide bars each having front and rear ends connected movably and respectively to an upstanding support and a flywheel, two pedal seats mounted slidably and respectively on the slide bars, two handles connected pivotally to the upstanding support, two slide guides each attached to one of the upstanding support and the flywheel to hold slidably one of the front and rear ends of one of the slide bars, two first link arms having front ends connected pivotally and respectively to the handles, and two second link arms each having front and rear ends connected pivotally and respectively to the respective handle and the corresponding pedal seat. The rear end of each first link arm is connected pivotally to the corresponding slide bar or slide guide.

12 Claims, 15 Drawing Sheets

ELLIPTICAL EXERCISING APPARATUS

BACKGROUND OF THE INVENTION

1. Field of the Invention

The invention relates to exercise equipment, more particularly to an elliptical exercising apparatus.

2. Description of the Related Art

Referring to FIG. 1, a conventional elliptical exercising apparatus comprises a main frame 11, a crank assembly 12, two handle assemblies 13, and two pedal assemblies 14. The main frame 11 includes a base support 111 mounted on a supporting surface, such as the ground, and an upstanding support 112 connected to a front end portion of the base support 111. The upstanding support 112 has a top portion provided with a console panel 113.

The crank assembly 12 includes a crank wheel 121 mounted pivotally to a rear end portion of the base support 111, and a pair of crank members 122 connected pivotally and respectively to two opposite sides of the crank wheel 121.

Each of the handle assemblies 13 includes a connecting section 131, a grip section 132 extending upwardly from the connecting section 131, and a pivot section 133 between the connecting and grip sections 131, 132. The pivot sections 133 of the handle assemblies 13 are connected pivotally and respectively to left and right sides of the upstanding support 112.

Each of the pedal assemblies 14 includes a pedal axle 141, and a pedal member 142 fixed on the pedal axle 141. The pedal axle 141 has a front end connected pivotally to the connecting section 131 of the corresponding handle assembly 13, and a rear end connected pivotally to the corresponding crank member 122.

During exercise, the user steps on the pedal members 142 of the pedal assemblies 14 with his/her hands grasping the respective grip sections 132 of the handle assemblies 13, and then exerts a force on the pedal members 142 in an alternate manner so as to bring the corresponding handle assemblies 13 to swing forward and rearward through the resulting movement of the pedal axles 141 of the pedal assemblies 14. Through coordination of the swinging movement of the handle assemblies 13 and reciprocating movement of the pedal assemblies 14, an exercise simulating striding movement is effected.

Since the pedal members 142 are fixed on the respective pedal axles 141, the pedal members 142 can only move along with the pedal axles 141. Further, movement of the pedal axles 141 is limited by the lengths of the crank members 122 to thereby limit the striding distance, which is defined as the distance traveled by the user's feet during each striding movement. As such, the user's leg muscles cannot be fully exercised, thereby limiting the effectiveness of the conventional elliptical exercising apparatus. If the length of each crank member 122 is increased so as to obtain a larger striding distance, the volume of the conventional elliptical exercising apparatus is also increased, thereby making storage, transport, and rearrangement of the position of the apparatus inconvenient.

SUMMARY OF THE INVENTION

Therefore, the object of the present invention is to provide an elliptical exercising apparatus that can permit full movement of the user's legs during exercise and that can permit adjustment of a striding distance so as to correspond to the different exercise requirements of each user.

According to this invention, an elliptical exercising apparatus comprises a main frame, a flywheel assembly, longitudinal left and right slide bars, left and right pedal seats, left and right handles, left and right slide guides, left and right first link arms, and left and right second link arms. The main frame includes a base support adapted to be supported on a supporting surface, and an upstanding support connected to a front end portion of the base support. The flywheel assembly includes a flywheel mounted rotatably on a rear end portion of the base support. Each of the left and right slide bars has a front end connected movably to the upstanding support, and a rear end connected movably to the flywheel. The left and right pedal seats are mounted slidably and respectively on the left and right slide bars. The left and right handles are connected pivotally to the upstanding support. Each of the handles has a lower connecting section, a grip section extending upwardly from the lower connecting section, and a pivot section between the lower connecting section and the grip section. Each of the left and right slide guides is attached to one of the upstanding support and the flywheel to hold slidably one of the front and rear ends of one of the slide bars. The left and right first link arms have front ends connected pivotally and respectively to the lower connecting sections of the left and right handles. The left first link arm has a rear end connected pivotally to one of the left slide guide and the left slide bar. The right first link arm has a rear end connected pivotally to one of the right slide guide and the right slide bar. Each of the left and right second link arms has a front end connected pivotally to the lower connecting section of a respective one of the left and right handles, and a rear end connected pivotally to a corresponding one of the left and right pedal seats. The slide bars slide relative to one of the upstanding support and the flywheel when the flywheel rotates.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
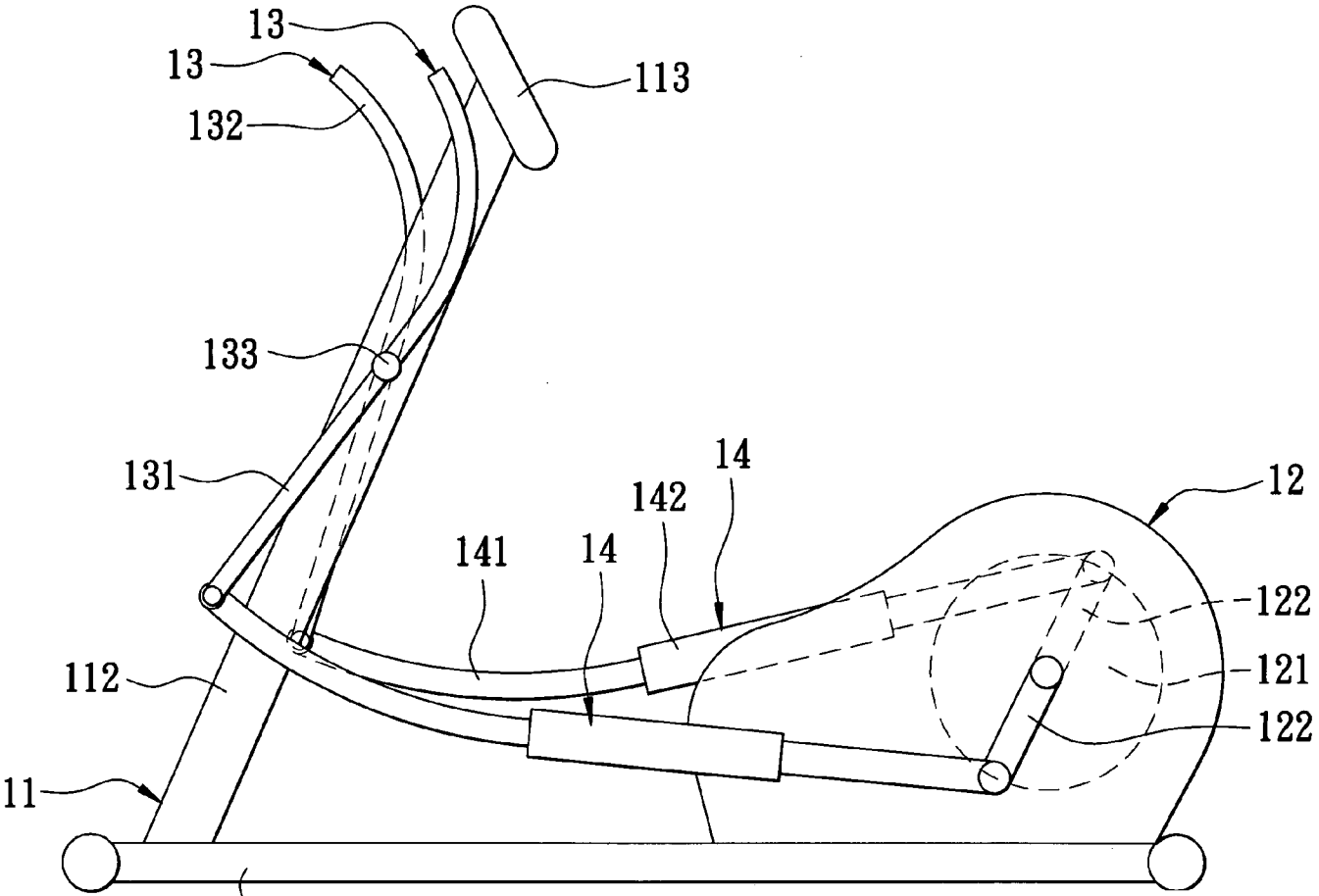
FIG. 1 PRIOR ART
FIG. 1 is a schematic side view of a conventional elliptical exercising apparatus.

Before the present invention is described in greater detail, it should be noted that like elements are denoted by the same reference numerals throughout the disclosure.

Figure 2:
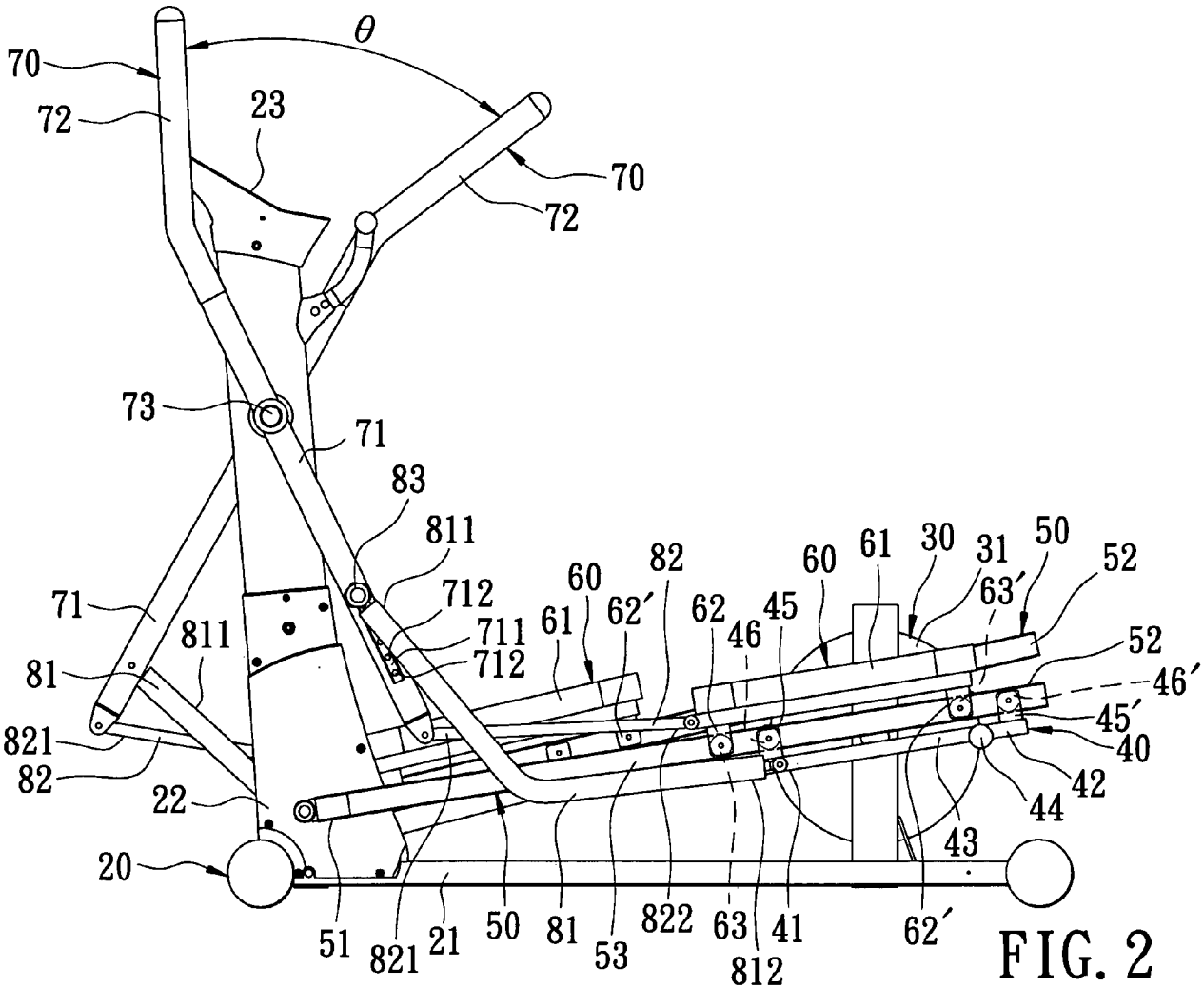
FIG. 2 is a schematic side view of the first preferred embodiment of an elliptical exercising apparatus according to the present invention.
Figure 3:
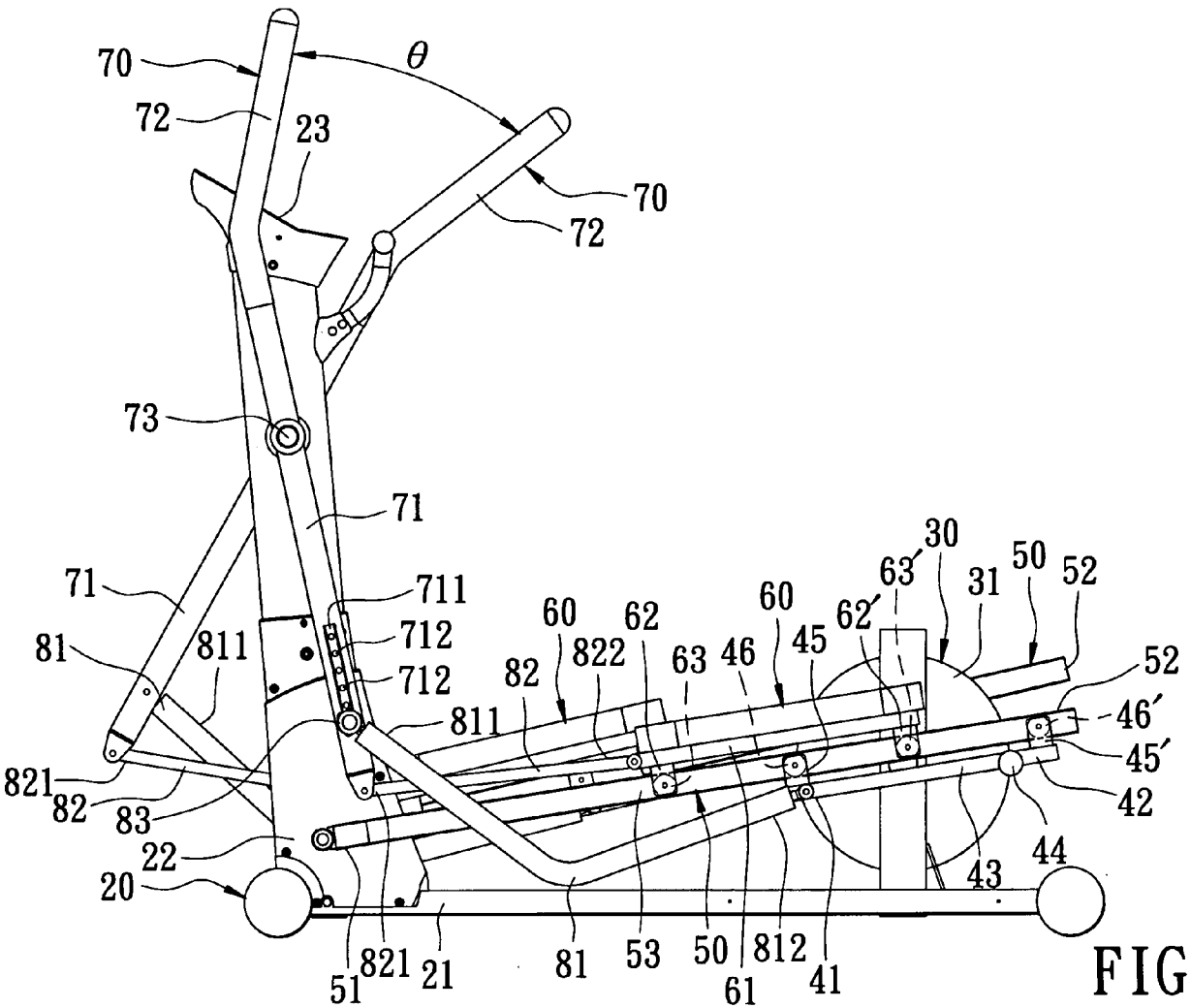
FIG. 3 is the same view as FIG. 2, but illustrating a front end of each slide bar connected to a handle at a lowest position.
Figure 4:
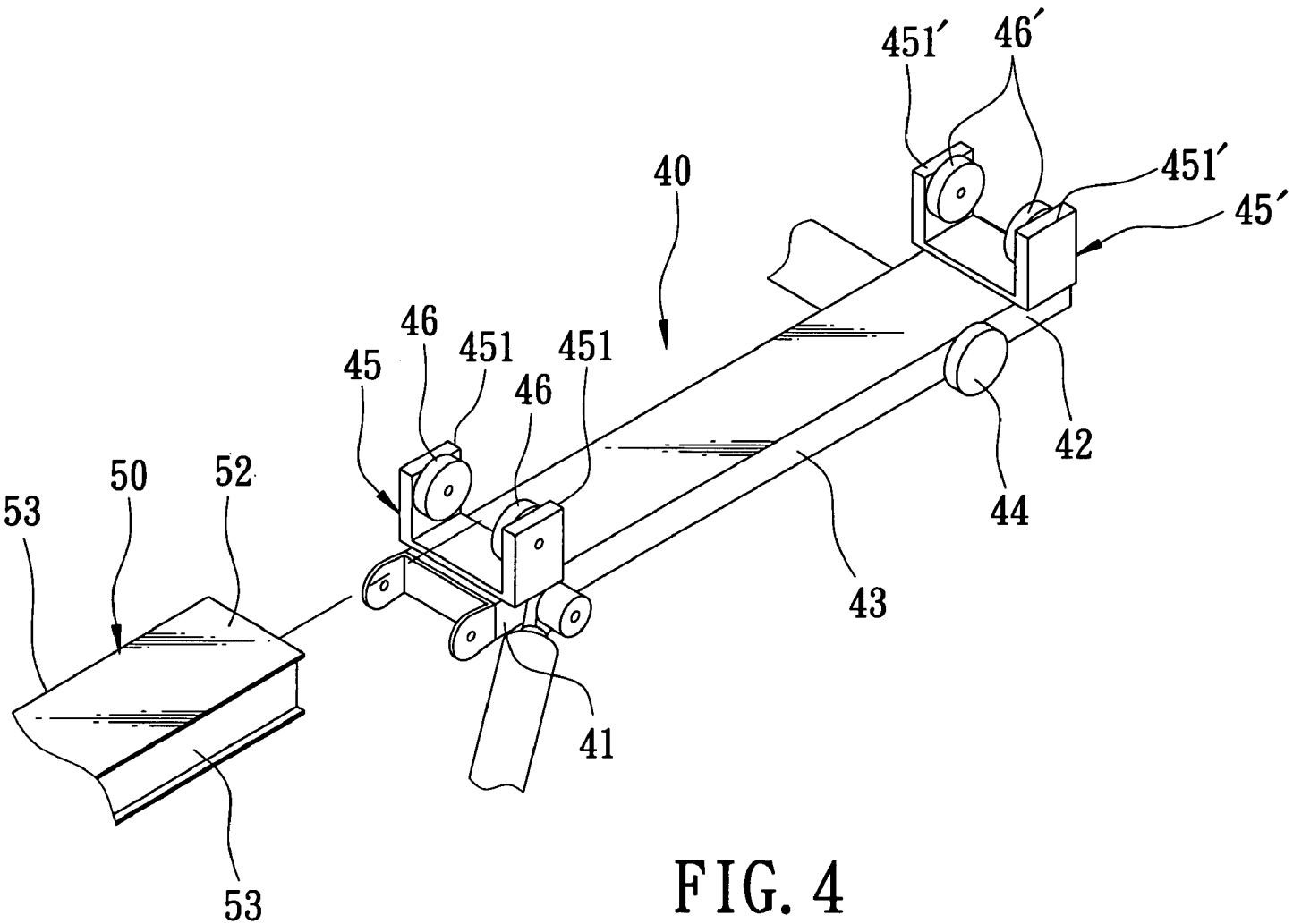
FIG. 4 is an enlarged perspective view of a slide guide of the first preferred embodiment.
Figure 5:
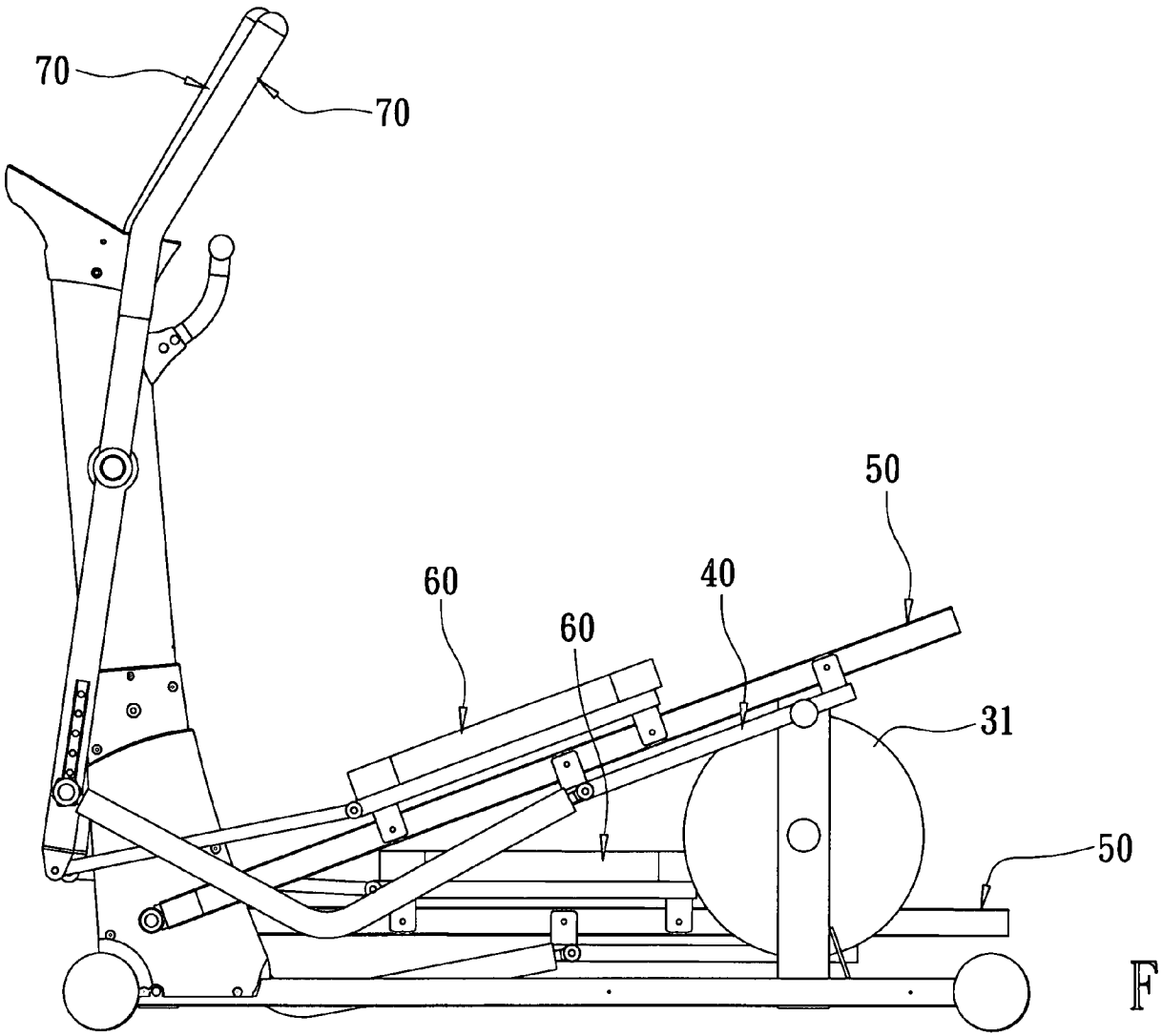
FIG. 5 is a view similar to FIG. 3, but illustrating a crank pin of a flywheel at a topmost position.
Figure 6:
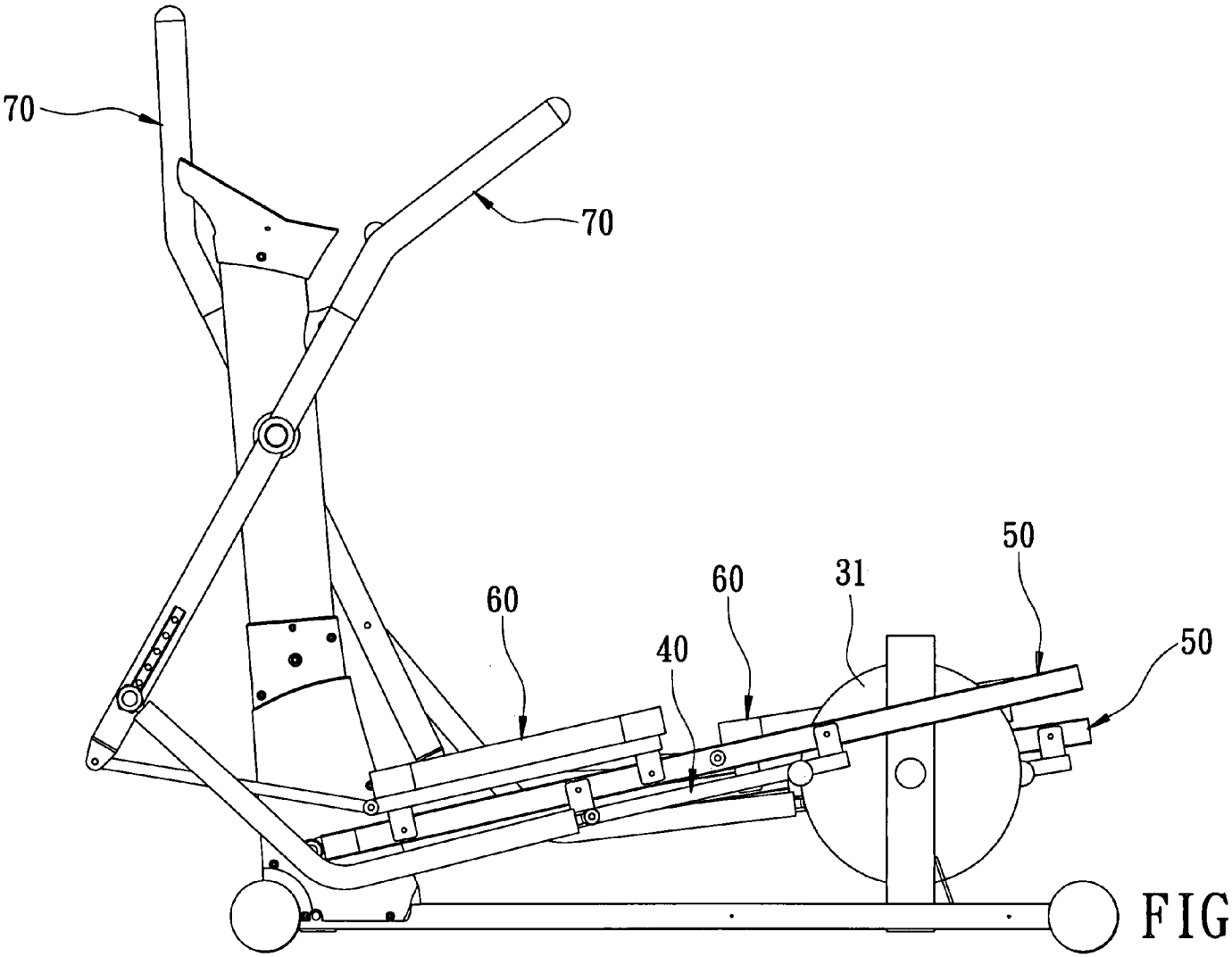
FIG. 6 is a view similar to FIG. 3, but illustrating the crank pin of the flywheel at a foremost position.
Figure 7:
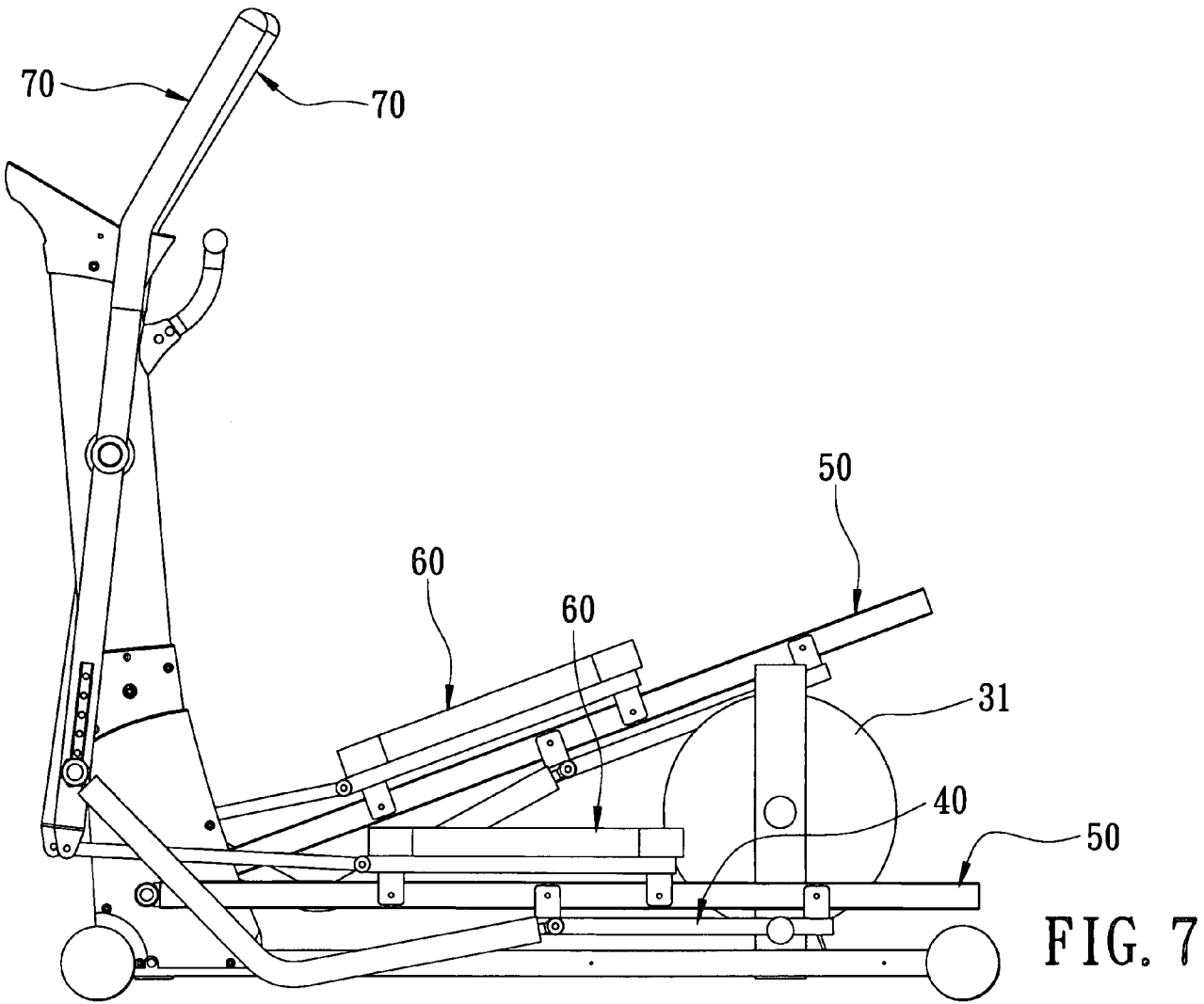
FIG. 7 is a view similar to FIG. 3, but illustrating the crank pin of the flywheel at a bottommost position.

Referring to FIGS. 2 to 4, the first preferred embodiment of an elliptical exercising apparatus according to the present invention is shown to comprise a main frame 20, a flywheel assembly 30, left and right slide guides 40, longitudinal left and right slide bars 50, left and right pedal seats 60, left and right handles 70, left and right first link arms 81, and left and right second link arms 82.

The main frame 20 includes a base support 21 adapted to be mounted on a supporting surface, such as the ground, and an upstanding support 22 connected to a front end portion of the base support 21. A console panel 23 is provided on top of the upstanding support 22 in a conventional manner.

The flywheel assembly 30 includes a flywheel 31 mounted rotatably on a rear end portion of the base support 21. The flywheel 31 has left and right crank pins 44 (only one is visible in FIGS. 2 and 3) offset from an axis of the flywheel 31.

The left and right slide guides 40 are connected pivotally and respectively to the left and right sides of the flywheel 31. Each of the left and right slide guides 40 includes a seat plate 43 connected pivotally to a corresponding one of the left and right crank pins 44 proximate to a rear end 42 thereof, a substantially U-shaped front plate 45 connected to a front end 41 of the seat plate 43 and having two opposite side plates 451, a substantially U-shaped rear plate 45' connected to the rear end 42 of the seat plate 43 and having two opposite side plates 451', a pair of front guide rollers 46 mounted respectively on inner faces of the side plates 451, and a pair of rear guide rollers 46' mounted respectively on inner faces of the side plates 451'.

The left and right slide bars 50 have front ends 51 connected pivotally and respectively to the left and right sides of the upstanding support 22, and rear ends 52 inserted slidably and respectively into the seat plates 43 between the side plates 451 and 451'. The left and right slide bars 50 are formed with left and right slide grooves 53 (only the right slide groove 53 is shown) that extend from the respective front ends 51 to the corresponding rear ends 52 to receive respectively the guide rollers 46 and 46'. The slide guides 40 hold slidably and respectively the rear ends 52 of the left and right slide bars 50 so that the slide bars 50 can slide relative to the flywheel 31 when the flywheel rotates. The seat plates 43 are spaced apart from and are located below the respective slide bars 50 so as to permit sliding movement of the slide guides 40 along the respective slide bars 50.

The left and right pedal seats 60 are mounted slidably and respectively on the left and right slide bars 50. Each of the left and right pedal seats 60 includes a pedal plate 61 spaced apart from and located above a corresponding one of the left and right slide bars 50, a pair of opposite front side plates 62 extending downwardly from a front end of the slide plate 61, a pair of opposite rear side plates 62' extending downwardly from a rear end of the slide plate 61, a pair of front guide rollers 63 mounted respectively on inner faces of the front side plates 62, and a pair of rear guide rollers 63' mounted respectively on inner faces of the rear side plates 62'. The guide rollers 63 and 63' are received respectively in the left and right slide grooves 53 in the slide bars 50 so that the left and right pedal seats 60 can slide along the length of the respective slide bars 50.

Each of the left and right handles 70 includes a lower connecting section 71, a grip section 72 opposite to the lower connecting section 71, and a pivot section 73 between the lower connecting section 71 and the grip section 72. The lower connecting section 71 has an adjustment unit 711 composed of a plurality of vertically spaced-apart connecting holes 712. Each of the connecting holes 712 has an internal thread. The pivot sections 73 of the left and right handles 70 are connected respectively to the left and right sides of the upstanding support 22.

The left and right first link arms 81 have front ends 811 connected pivotally, selectively, and respectively to the adjustment units 711 on the lower connecting sections 71 of the left and right handles 70, and rear ends 812 connected pivotally and respectively to the front ends 41 of the left and right slide guides 40. The front end 811 of each of the left and right first link arms 81 has a pivot pin 83 inserted into a selected one of the connecting holes 712 so that the height of each first link arm 81 relative to the lower connecting section 71 of the corresponding handle 70 can be adjusted.

Each of the left and right second link arms 82 has a front end 821 connected pivotally to the lower connecting section 71 of the respective one of the left and right handles 70, and a rear end 822 connected pivotally to a front end of the pedal plate 61 of the corresponding one of the left and right pedal seats 60.

After assembly of the aforementioned components, when the pedal seats 60 and the handles 70 are moved by the user, the flywheel 31 rotates, and the slide guides 40 move forward and rearward and upward and downward along with the flywheel 31, thereby producing an elliptical motion of the pedal seats 60.

With reference to FIG. 2, when each of the left and right first link arms 81 is pivoted to the uppermost connecting hole 712 in the lower connecting section 71 of the corresponding handle 70, a maximum included angle (θ) between the left and right handles 70, as well as a maximum distance between the left and right pedal seats 60 may be achieved. Hence, the trace of the elliptical motion of the pedal seats 60 is also at a maximum. Referring to FIG. 3, when each of the left and right first link arms 81 is pivoted to the lowermost connecting hole 712 in the lower connecting section 71 of the corresponding handle 70, a minimum included angle (θ) between the left and right handles 70, as well as a minimum distance between the left and right pedal seats 60 may be effected. Hence, the trace of the elliptical motion of the pedal seats 60 is also at a minimum.

From the aforementioned description, it is apparent that when the user wants to increase or decrease the striding distance traveled by his/her feet, he/she may simply adjust the left and right first link arms 81 to the desired heights by engaging the pivot pins 83 to the selected ones of the connecting holes 712 in the corresponding handles 70. This adjustment changes the position of the left and right pedal seats 60 and the extent of the included angle (θ) between the left and right handles 70. The striding distance can therefore be adjusted easily to conform to each user's exercise requirements.

With reference to FIGS. 3, 5, 6, and 7, each of the left and right first link arms 81 is pivoted to the lowermost connecting hole 712 in the corresponding handle 70. When a pivot point of the slide guides 40 is located at a 3 o'clock position (see FIG. 3) or at a 9 o'clock position (see FIG. 6), the left and right pedal seats 60 are spread apart from each other in a horizontal manner, i.e., one of the pedal seats 60 is located in front of the other. When the pivot point of the slide guides 40 is located at a 12 o'clock position (see FIG. 5) or at a 6 o'clock position (see FIG. 7), the left and right pedal seats 60 are spread apart from each other in a vertical manner, i.e., one of the left and right pedal seats 60 is disposed above the other. The changes in position of the pedal seats 60 during an elliptical exercising motion of the user's feet are shown consecutively in FIGS. 3, 5, 6, and 7.

Figure 8:
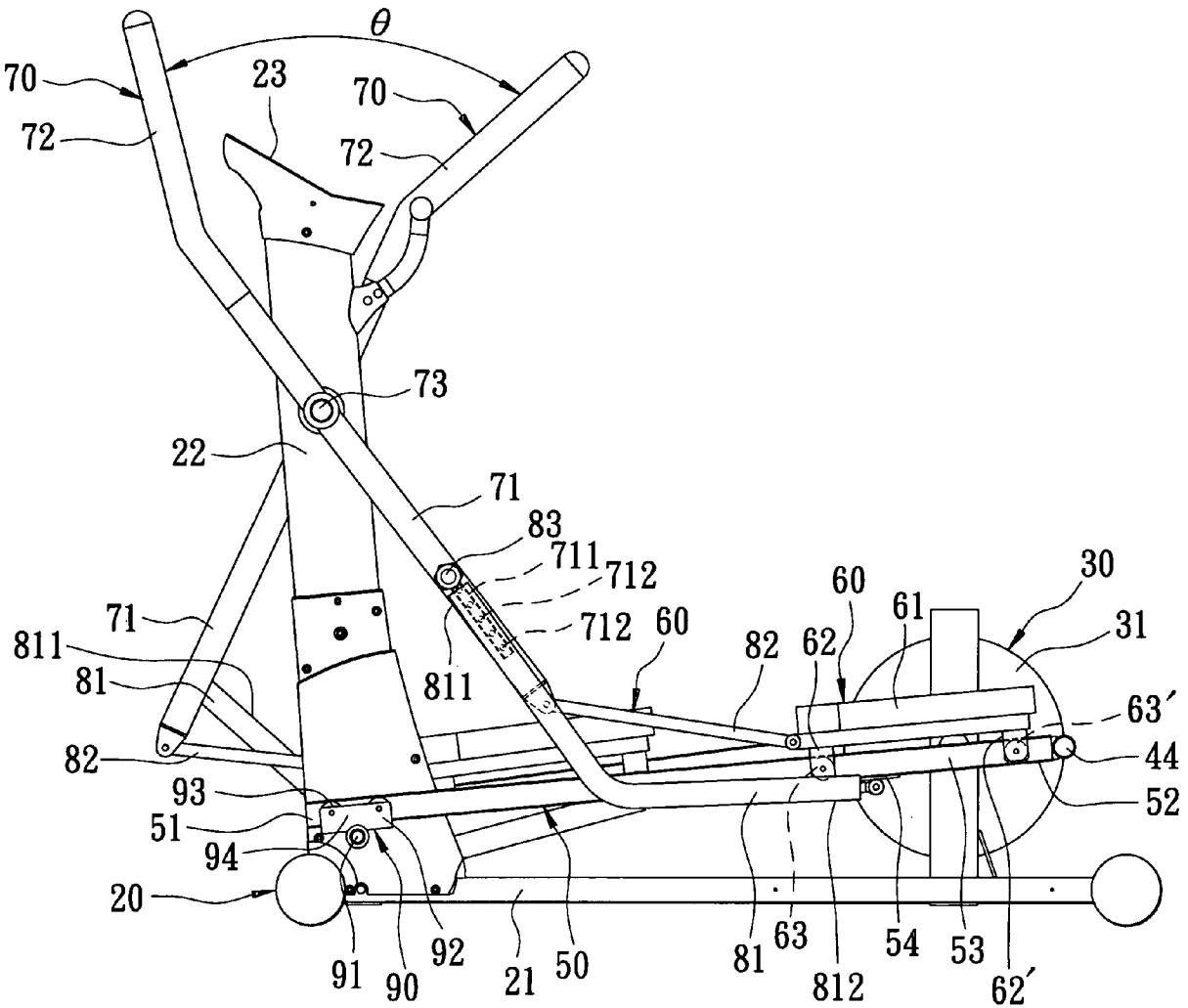
FIG. 8 is a schematic side view of the second preferred embodiment of an elliptical exercising apparatus according to the present invention.
Figure 9:
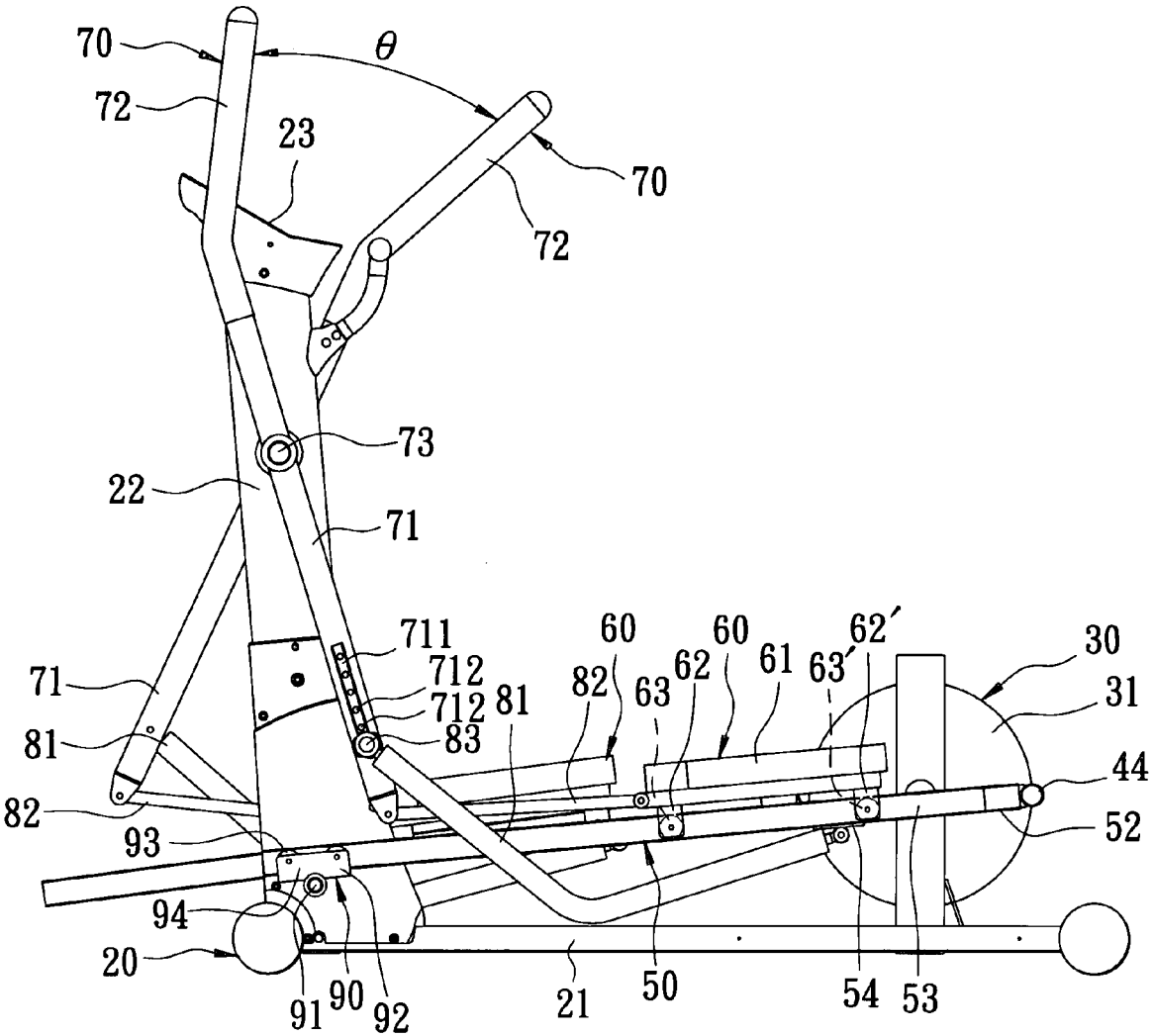
FIG. 9 is the same view as FIG. 8, but illustrating a front end of each slide bar connected to a handle at a lowest position.
Figure 10:
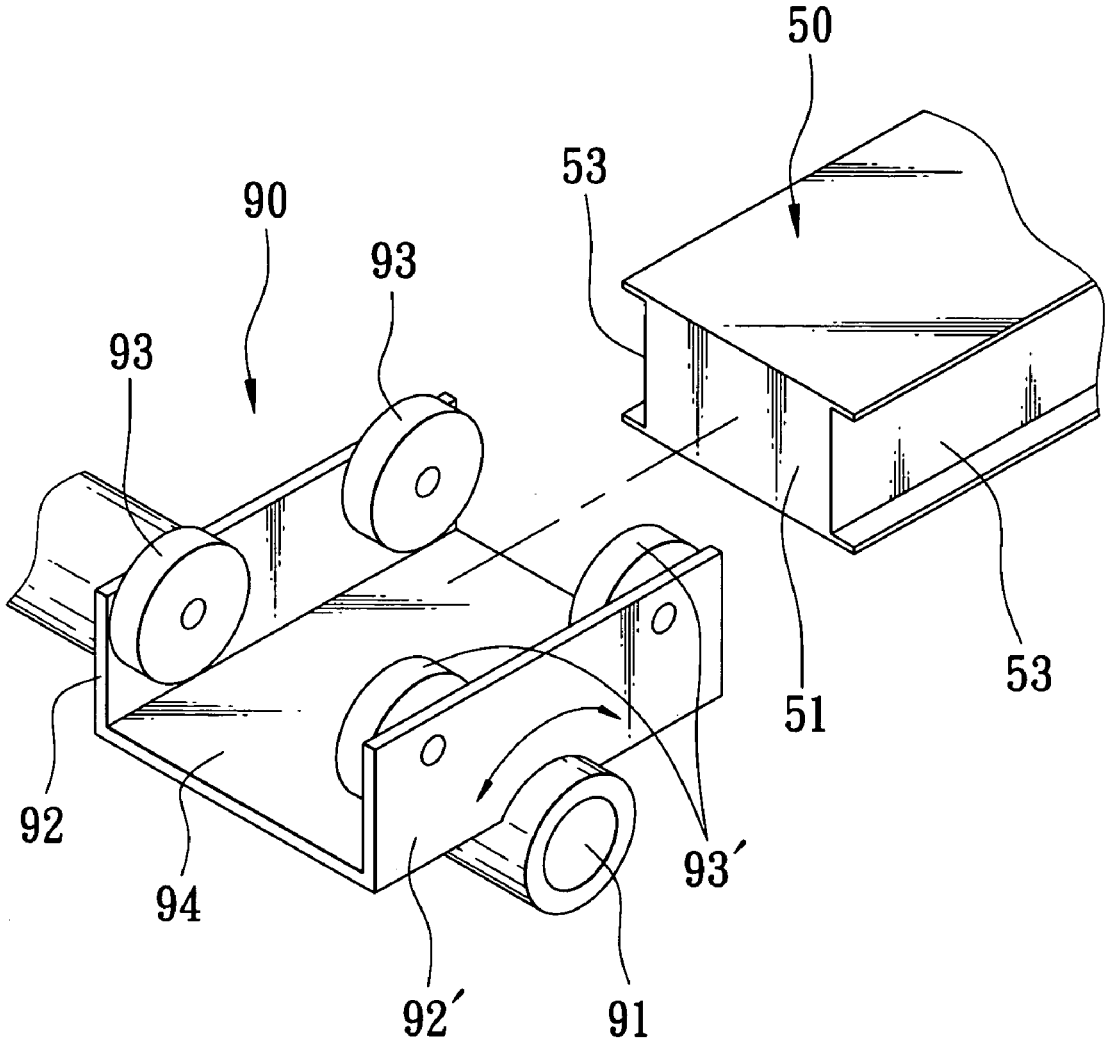
FIG. 10 is an enlarged perspective view of a slide guide of the second preferred embodiment.
Figure 11:
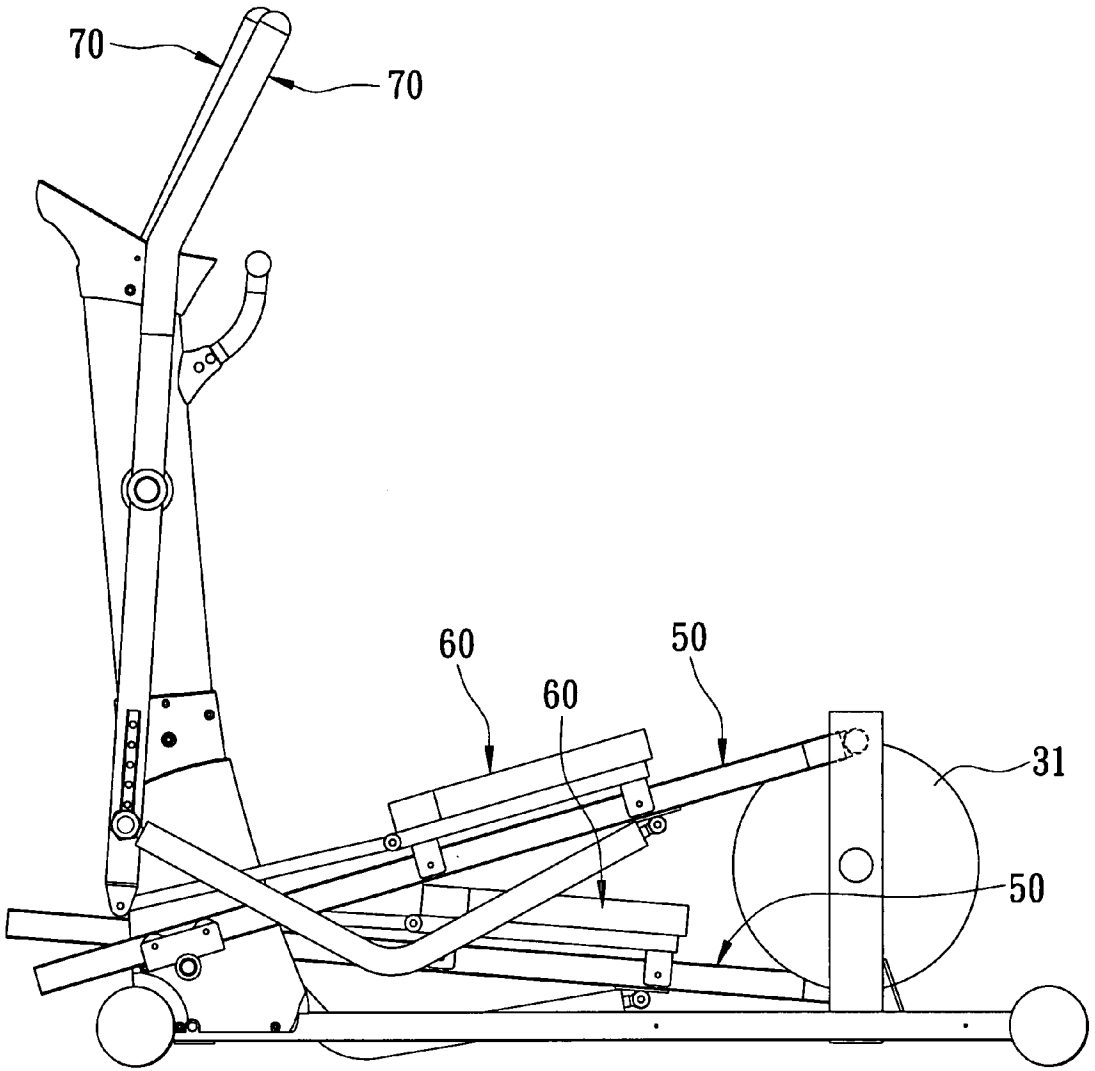
FIG. 11 is a view similar to FIG. 9, but illustrating a crank pin of a flywheel at a topmost position.
Figure 12:
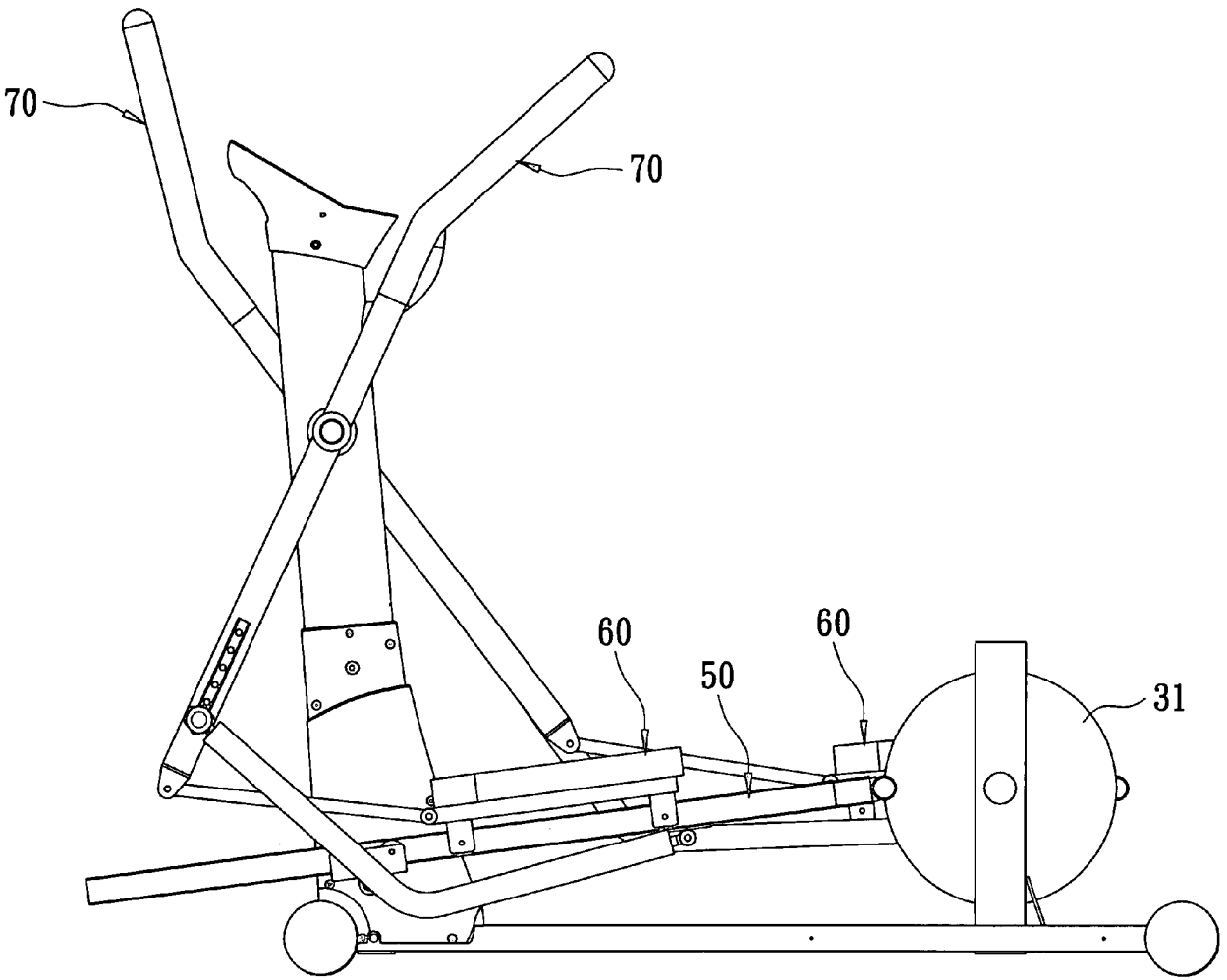
FIG. 12 is a view similar to FIG. 9, but illustrating the crank pin of the flywheel at a foremost position.
Figure 13:
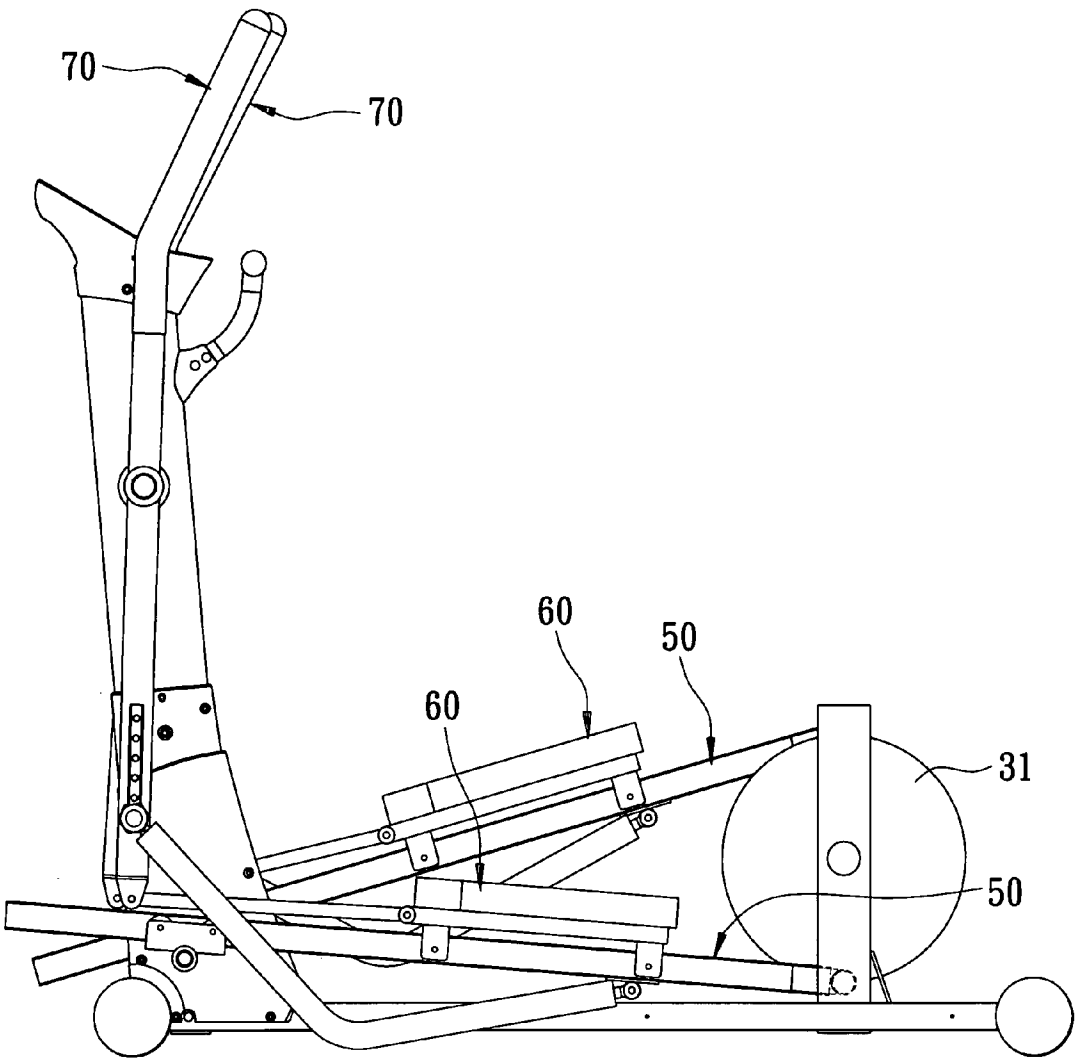
FIG. 13 is a view similar to FIG. 9, but illustrating the crank pin of the flywheel at a bottommost position.

Referring to FIGS. 8, 9, and 10, the second preferred embodiment of an elliptical exercising apparatus according to the present invention is shown to be similar to the first preferred embodiment. However, in this embodiment, the slide guides 90 are connected pivotally and respectively to the left and right sides of the upstanding support 22 proximate to the base support 21. The upstanding support 22 is provided with two tubular members 91 (only one is visible) projecting respectively from the left and right sides thereof. Each of the slide guides 90 includes a substantially U-shaped seat plate 94 mounted pivotally on the corresponding tubular member 91 and having left and right side plates 92, 92', two left guide rollers 93 mounted on inner faces of the left side plate 92, and two right guide rollers 93' mounted on inner faces of the right side plate 92'.

The front end 51 of each of the left and right slide bars 50 is inserted slidably into the connecting plate 94 of the corresponding slide guide 90 between the side plates 92 with the left and right slide grooves 53 receiving respectively the left and right guide rollers 93, 93'. The rear end 52 of each of the left and right slide bars 50 is connected pivotally to the corresponding one of the left and right crank pins 44 (only one is visible in FIGS. 8 and 9) of the flywheel 31. Each of the left and right slide bars 50 further has a driven section 54 provided proximate to the rear end 52 thereof. In this embodiment, the slide guides 90 hold slidably and respectively the front ends 51 of the left and right slide bars 50 so that the slide bars 50 can slide relative to the upstanding support 22 when the rear ends 52 of the slide bars 50 are rotated.

The rear ends 812 of the left and right first link arms 81 in this embodiment are connected respectively to bottom faces of the driven sections 54 of the slide bars 50. The front ends of the left and right first link arms 81 are similarly connected pivotally, respectively, and selectively to the adjustment units 711 of the lower connecting sections 71 of the left and right handles 70. Hence, when the pedal seats 60 and the left and right handles 70 are moved, the flywheel 31 rotates, and the slide bars 50 move frontward and rearward and upward and downward, thereby producing the elliptical exercise motion.

With reference to FIG. 8, when each of the left and right first link arms 81 is pivoted to the uppermost connecting hole 712 in the lower connecting section 71 of the corresponding handle 70, a maximum included angle (θ) between the left and right handles 70, as well as a maximum distance between the left and right pedal seats 60 may be achieved, so that the trace of the elliptical motion of the pedal seats 60 is also at a maximum. Referring to FIG. 9, when each of the left and right first link arms 81 is pivoted to the lowermost connecting hole 712 in the lower connecting section 71 of the corresponding handle 70, a minimum included angle (θ) between the left and right handles 70, as well as a minimum distance between the left and right pedal seats 60 may be effected, so that the trace of the elliptical motion of the pedal seats 60 is also at a minimum.

With reference to FIGS. 9, 11, 12, and 13, when a pivot point of the slide bars 50 is located at a 3 o'clock position (see FIG. 9) or at a 9 o'clock position (see FIG. 12), the left and right pedal seats 60 are spread apart from each other in a horizontal manner, i.e., one of the left and right pedal seats 60 is disposed in front of the other. When the pivot point of the slide bars 50 is located at a 12 o'clock position (see FIG. 11) or at a 6 o'clock position (see FIG. 13), the left and right pedal seats 60 are spread apart from each other in a vertical manner, i.e., one of the left and right pedal seats 60 is disposed above the other. The positions of the pedal seats 60 during the elliptical exercising motion of the user's feet are shown consecutively in FIGS. 9, 11, 12, and 13.

Therefore, the effects and advantages of the first preferred embodiment can be similarly achieved in the second preferred embodiment.

Figure 14:
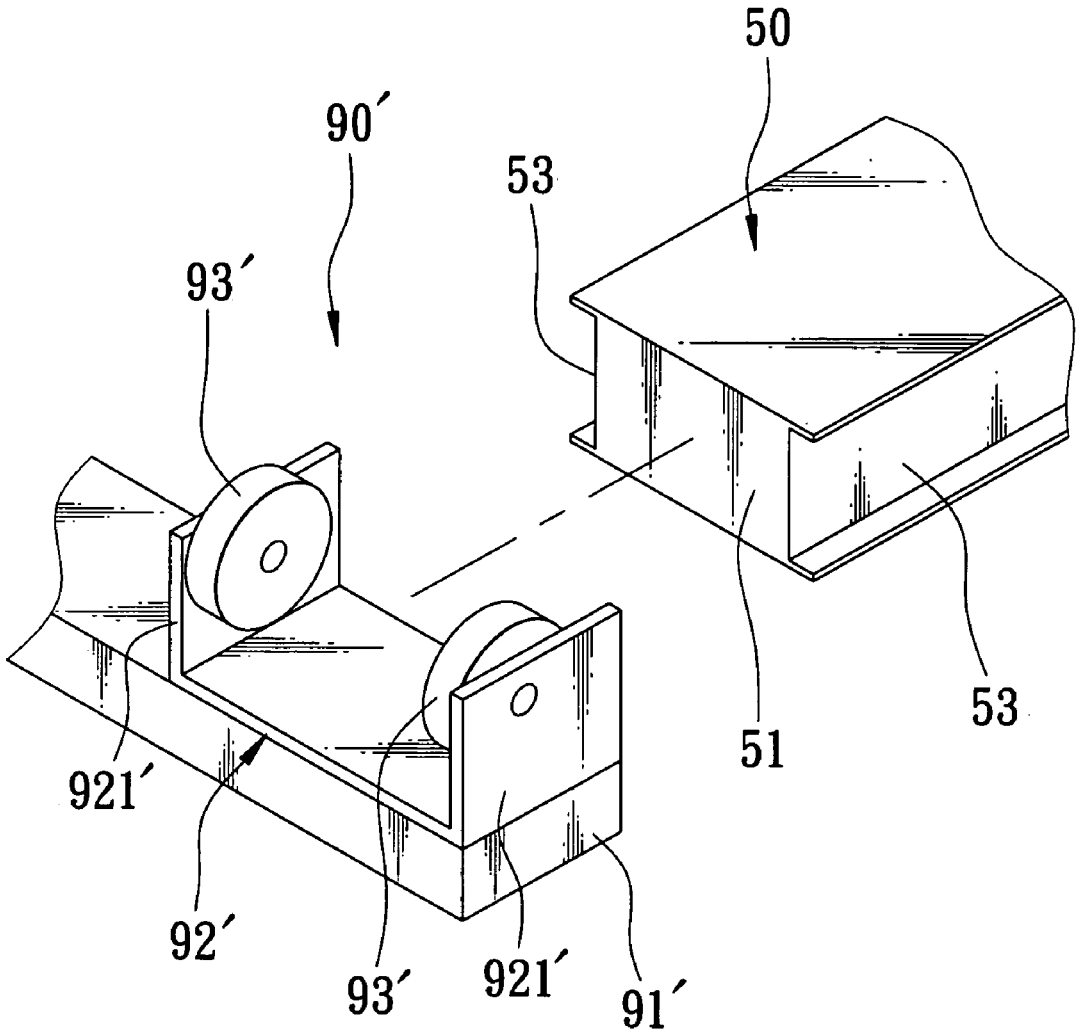
FIG. 14 is an alternative structure of the slide guide of the second preferred embodiment.
Figure 15:
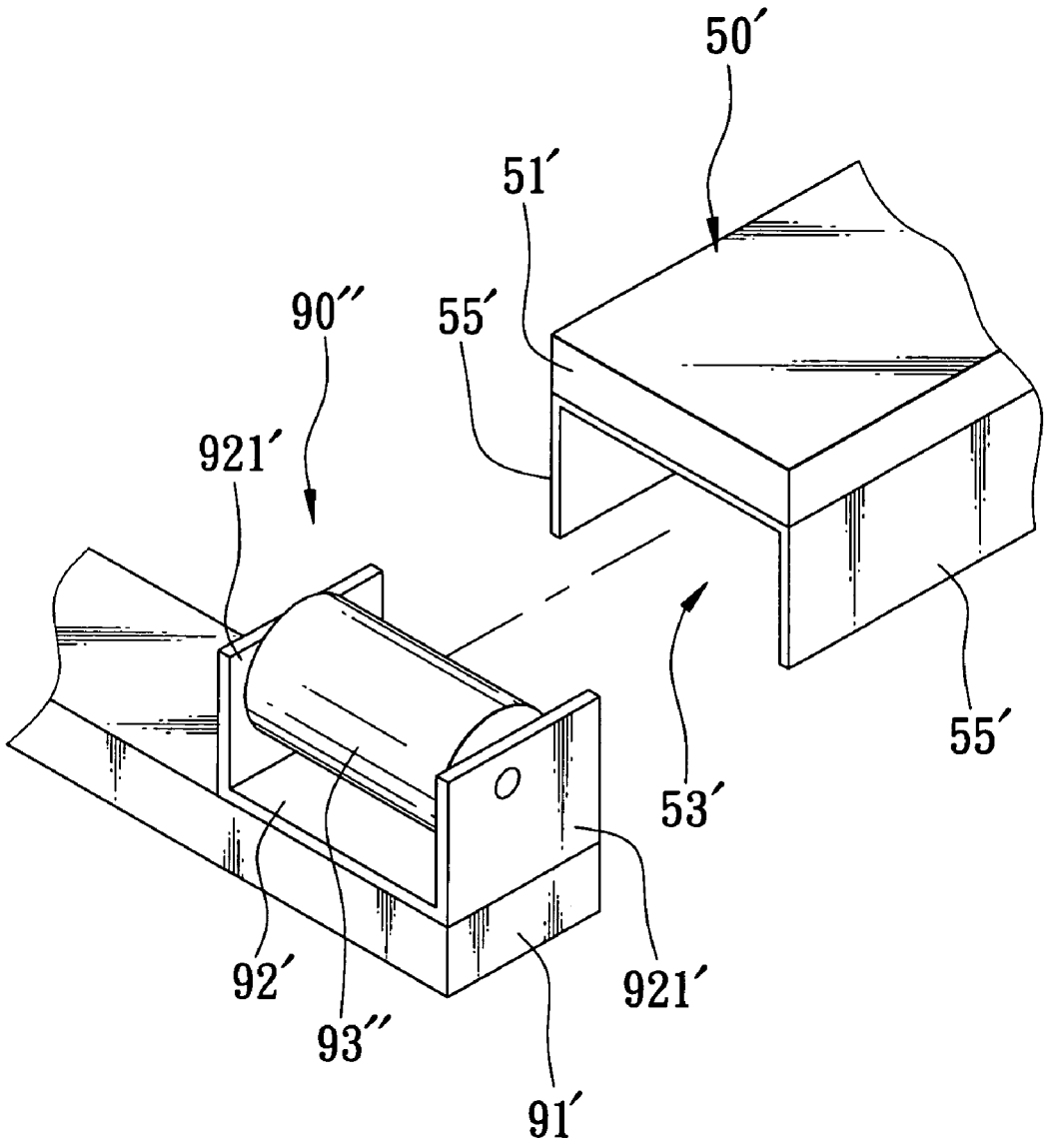
FIG. 15 is another alternative structure of the slide guide of the second preferred embodiment.

According to the present invention, the construction of each slide guide 90 may be varied. In FIG. 14, each slide guide 90' has a mounting plate 91' fixed to the corresponding left or right side of the upstanding support 22 (see FIG. 8), a substantially U-shaped seat plate 92' connected to the mounting plate 91' and having two opposite side plates 921', and two guide rollers 93' mounted respectively on inner faces of the side plates 921'. Each slide bar 50 can be similarly slidable along the U-shaped seat plate 92' by engaging slidably the slide grooves 53 with the respective guide rollers 93'. In FIG. 15, each slide guide 90" has one guide roller 93" between two side plates 921' of the U-shaped seat plate 92'. In this case, each of the left and right slide bars 50' includes two side plates 55' extending downwardly from left and right sides of the corresponding slide bar 50' and cooperating with a bottom face of the corresponding slide bar 50' to define a slide groove 53' so that each slide bar 50' can be slid along the corresponding slide guide 90".

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

We claim:

1. An elliptical exercising apparatus comprising:

a main frame including a base support adapted to be supported on a supporting surface, and an upstanding support connected to a front end portion of said base support;

a flywheel assembly including a flywheel mounted rotatably on a rear end portion of said base support;

longitudinal left and right slide bars each having a front end connected movably to said upstanding support, and a rear end connected movably to said flywheel;

left and right pedal seats mounted slidably and respectively on said left and right slide bars;

left and right handles connected pivotally to said upstanding support, each of said left and right handles having a lower connecting section, a grip section extending upwardly from said lower connecting section, and a pivot section between said lower connecting section and said grip section;

left and right slide guides each attached to one of said upstanding support and said flywheel to hold slidably one of said front and rear ends of one of said slide bars;

left and right first link arms having front ends connected pivotally and respectively to said lower connecting sections of said left and right handles, said left first link arm having a rear end connected pivotally to one of said left slide guide and said left slide bar, said right first link arm having a rear end connected pivotally to one of said right slide guide and said right slide bar; and left and right second link arms each having a front end connected pivotally to said lower connecting section of a respective one of said left and right handles, and a rear end connected pivotally to a corresponding one of said left and right pedal seats, wherein said slide bars slide relative to one of said upstanding support and said flywheel when said flywheel rotates.

2. The elliptical exercising apparatus of claim 1, wherein said lower connecting section has an adjustment unit which is connected pivotally to said front end of the corresponding one of said left and right first link arms and which adjusts the height of the corresponding one of said left and right first link arms relative to said lower connecting section.

3. The elliptical exercising apparatus of claim 2, wherein said adjustment unit is composed of a plurality of vertically spaced-apart connecting holes, said front end of the corresponding one of said left and right first link arms having a pivot pin inserted into a selected one of said connecting holes.

4. The elliptical exercising apparatus of claim 1, wherein said front ends of said left and right slide bars are connected pivotally and respectively to left and right sides of said upstanding support, said left and right slide guides are connected respectively to left and right sides of said flywheel to hold slidably and respectively said rear ends of said left and right slide bars, and said rear ends of said left and right first link arms are connected pivotally and respectively to said left and right slide guides.

5. The elliptical exercising apparatus of claim 4, wherein each of said left and right slide guides includes a seat plate connected to and located below a corresponding one of said left and right slide bars, a pair of opposite side plates extending upwardly from said seat plate, and a pair of guide rollers mounted respectively on inner faces of said side plates, each of said left and right slide bars being disposed slidably on said seat plate between said side plates and being formed with left and right slide grooves to receive respectively said guide rollers.

6. The elliptical exercising apparatus of claim 5, wherein said flywheel has an axis, and a crank pin offset from said axis of said flywheel and connected pivotally to said seat plate.

7. The elliptical exercising apparatus of claim 4, wherein each of said left and right pedal seats includes a pedal plate connected to and located above the corresponding one of said left and right slide bars, a pair of opposite lateral plates extending downwardly from said pedal plate, and a pair of slide rollers mounted respectively on inner faces of said lateral plates, each of said left and right slide bars being formed with left and right slide grooves to receive slidably said slide rollers.

8. The elliptical exercising apparatus of claim 1, wherein said rear ends of said left and right slide bars are connected pivotally and respectively to left and right sides of said flywheel, said left and right slide guides are connected respectively and pivotally to left and right sides of said upstanding support to hold slidably and respectively said front ends of said left and right slide bars, and said rear ends of said left and right first link arms are connected pivotally and respectively to said left and right slide bars.

9. The elliptical exercising apparatus of claim 8, wherein each of said left and right slide guides includes a seat plate mounted pivotally on said upstanding support, a pair of opposite side plates extending upwardly from said seat plate, and at least one guide roller mounted on an inner face of a corresponding one of said side plates, each of said left and right slide bars being disposed slidably on said seat plate between said side plates and being formed with at least one slide groove to receive said guide roller.

10. The elliptical exercising apparatus of claim 9, wherein each of said left and right slide guides includes a pair of said guide rollers mounted respectively on the inner faces of said side plates, each of said left and right slide bars being formed with a pair of said slide grooves to receive respectively said guide rollers.

11. The elliptical exercising apparatus of claim 9, wherein said flywheel has an axis, and a crank pin offset from said axis of said flywheel, said rear ends of said left and right slide bars being connected pivotally to said crank pin.

12. The elliptical exercising apparatus of claim 8, wherein each of said left and right pedal seats includes a pedal plate connected to and located above the corresponding one of said left and right slide bars, a pair of opposite lateral plates extending downwardly from said pedal plate, and a pair of slide rollers mounted respectively on inner faces of said lateral plates, each of said left and right slide bars being formed with left and right slide grooves to receive slidably said slide rollers.

* * * * *